United States Patent [19]

Brühwiler et al.

[11] 4,408,461

[45] Oct. 11, 1983

[54] COMBUSTION CHAMBER OF A GAS TURBINE WITH PRE-MIXING AND PRE-EVAPORATION ELEMENTS

[75] Inventors: Eduard Brühwiler, Nussbaumen; Hans Koch, Zurich, both of Switzerland

[73] Assignee: BBC Brown, Boveri & Company Limited, Baden, Switzerland

[21] Appl. No.: 198,929

[22] Filed: Oct. 20, 1980

[30] Foreign Application Priority Data

Nov. 23, 1979 [CH] Switzerland ..... 10444/79

[51] Int. Cl.³ ..... E02C 7/22

[52] U.S. Cl. ..... 60/737; 60/747

[58] Field of Search ..... 60/746, 747, 737

[56] References Cited

U.S. PATENT DOCUMENTS

| | | | |
|---|---|---|---|
| 4,107,918 | 8/1978 | Andrew | 60/746 |
| 4,222,232 | 9/1980 | Robinson | 60/746 |
| 4,262,482 | 4/1981 | Roffe et al. | 60/39.46 P |

*Primary Examiner*—Louis J. Casaregola

*Attorney, Agent, or Firm*—Werner W. Kleeman

[57] ABSTRACT

A combustion chamber for a gas turbine which is equipped with a number of tubular-shaped elements, within which there occurs between the fuel and the compressed air a pre-mixing/pre-evaporation process. Each tubular element is closed at its end at the side of its combustion space by a flame baffle provided with one or a number of openings, so that the combustion first can occur downstream of the flame baffle, whereby there is appreciably reduced the emissivity of noxious substances from the combustion process.

15 Claims, 16 Drawing Figures

COMBUSTION CHAMBER OF A GAS TURBINE WITH PRE-MIXING AND PRE-EVAPORATION ELEMENTS

BACKGROUND OF THE INVENTION

The present invention relates to a new and improved construction of a combustion chamber or compartment for a gas turbine, wherein within the combustion compartment casing or housing the air distribution chamber and combustion space or chamber are spatially separated from one another.

Gas turbines are increasingly subjected to the strict environmental regulations of many countries as concerns the composition of their exhaust gases. During the operation of gas turbines it is particularly difficult to comply with the regulations concerning the maximum permissible $NO_x$—emissions. Thus, at the present time regulations are in force, particularly in the United States of America, wherein the content of $NO_x$—emissions must not exceed 75 ppm at 15 percent by volume $O_2$. Similar regulations must be observed in most of the industrial countries, and it is to be expected that in the future the permissible emission values or coefficients will be set lower, i.e. become stricter. These regulations, up to the present time, only could be complied with by resorting to the technique of injecting large quantities of water and steam into the combustion compartment or chamber. These auxiliary aids, in other words, water or steam, which were employed to reduce the emissivity, however, are associated with a number of decisive drawbacks.

If water is injected into the combustion chamber, then there must be expected an impairment of the combustion efficiency. Additionally, water is not always available or in adequate quantities, particularly in countries having low precipitation. Furthermore, prior to using the water it must be processed because many minerals, such as, for instance, sodium, cooking salt and so forth, which appear in water have a markedly corrosive action upon their surroundings. This processing of the water is expensive and associated with considerable consumption of energy.

On the other hand, if steam is infed to the combustion chamber, then there can be circumvented the above-discussed impairment of the efficiency of the combustion process. Yet, generating steam presupposes that water is available and the preparation of steam from water equally requires considerable energy expenditure.

SUMMARY OF THE INVENTION

Therefore, with the foregoing in mind it is a primary object of the present invention to overcome the previously discussed drawbacks and limitations of the prior art.

Another and more specific object of the present invention aims at providing a new and improved construction of a combustion chamber for a gas turbine in which the noxious substances which are released by the combustion process drop below values permitted by emission standards or regulations.

Yet a further significant object of the present invention aims at providing a new and improved construction of combustion chamber for a gas turbine which effectively reduces the quantities of released noxious or environmental-endangering substances to within tolerable limits.

Now in order to implement these and still further objects of the invention, which will become more readily apparent as the description proceeds, the combustion compartment or chamber of the present development is manifested by the features that between an air distribution chamber and the combustion space or chamber there are arranged a number of tubular-shaped elements within which there occurs the pre-mixing and the pre-evaporation of a fuel oil infed by nozzles to the ends of such tubular-shaped elements located at the side of the air distributor or distribution chamber and/or there occurs the admixing of the combustion gas infed by nozzles to the ends of the tubular-shaped elements located at the side of the distributor chamber with the compressed air in the presence of a large excess-air coefficient. Each tubular-shaped element is closed at its end located at the side of the combustion space or chamber by a flame baffle provided with one or a number of openings. Between the tubular-shaped elements there is located one or a number of pilot elements.

The advantage of the invention particularly resides in the fact that the emission values or emissivity of noxious substances can be reduced below values permitted by emission standards or regulations, without the need for injecting expensive auxiliary substances into the combustion chamber. This is obtained in that a pre-mixing and pre-evaporation phase precedes the actual combustion process.

For this purpose the pre-mixing and pre-evaporation is accomplished in a number of tubular-shaped elements. The fuel together with the air from the compressor is pre-mixed and pre-evaporated with a large excess-air coefficient. The combustion with the greatest possible excess-air coefficient—realized, firstly, by the fact that the flame still burns and, secondly, that there is not formed too much CO—not only therefore reduces the noxious quantity of $NO_x$, but also additionally ensures that there is present a consistently low content of other noxious substances, mainly, as already mentioned, CO and uncombusted hydrocarbons. This optimization process can be operated, with the present combustion chamber of the invention, in the direction of still lower $NO_x$—values, since the space for combustion and post-reactions can be maintained much longer than would be needed for the actual combustion. This enables the selection of a larger excess-air coefficient, so that intially there are formed greater quantities of CO, such however can further react to form $CO_2$, so that finally the CO—emission remains small. On the other hand, only very little additional NO is formed due to the large excess air.

Since a number of tubular-shaped elements undertake the pre-mixing and pre-evaporation, there is thus realized the advantage that during load regulation it is only necessary to supply in each case that many elements with fuel as are needed to realize for the momentary operating phase (start, partial load and so forth) the optimum excess-air coefficient.

In the event there are employed a number of pilot elements, it is advantageous to uniformly geometrically distribute such below the employed tubular-shaped elements. If the former are placed into operation for the initial firing, then there are dispensed with such elements for other tubular-shaped elements which thereafter are placed into operation: the flames jump from the pilot elements to the surrounding elements, and thus, there is realized the benefit that the flame baffles of such pilot elements either can be provided with spin-imparting or twist-imparting bodies or inclined or oblique holes or openings, so that there are produced diverging flame tongues or licks which additionally afford a good calorific and air-jet like admixing. This becomes apparent in terms of a more uniform temperature and velocity distribution after the combustion chamber or space.

It is advantageous if both the inclined openings and also the openings which are parallel to the axis of the flame baffle and provided in the flame baffle, have a length of at least 1.5 times the diameter of such opening or hole. The air-fuel oil-vapour mixture or the air-combustion gas mixture, as the case may be, flows through such opening at increased velocity and into the combustion space or chamber, so that there is avoided flame backfiring.

A further design which is suitable for avoiding backfiring of the flames resides in designing the openings in the flame baffles as injectors, so that air can be introduced into the boundary layer of the openings.

A further design of the openings in the flame baffles resides in constructing such as diffusors. With this solution there is possible with the same pressure loss an increased velocity. The higher velocity affords greater security against backfiring of the flames out of the combustion space or chamber. For ensuring the proper mode of operation of the diffusor, it is necessary to subsequently arrange a cylindrical portion having a minimum length of 1.5 times the hole or opening diameter.

It is equally advantageous if the injection of the fuel is directed against the air flow direction. In this way there is enhanced the pre-mixing and pre-evaporation process to an extent such that the length of the tubular-shaped element can be maintained appreciably shorter in relation to another design of fuel infeed. Consequently, the residence time of the mixture within the tubular-shaped element is reduced and there is suppressed the danger of self-ignition.

Through the use of a rimmed or stepped mouth at the air inlet of the tubular-shaped element there is produced at such location turbulence which additionally intensifies the pre-mixing, atomization and pre-evaporation process.

It is advantageous to construct the circumference of the flame baffle edge as a polygon, so that the tubular-shaped elements interfit in a space-saving fashion.

It is recommended to form a number of openings at the edge of the flame baffle, about the outer shell or jacket of the tubular-shaped element. Through these openings there can flow a partial quantity of the compressor air and thus cool the edge of the flame baffle.

BRIEF DESCRIPTION OF THE DRAWINGS

The invention will be better understood and objects other than those set forth above, will become more readily apparent as the description proceeds. Such description makes reference to the annexed drawings wherein.

DETAILED DESCRIPTION OF THE PREFERRED EMBODIMENTS

Figure 1:
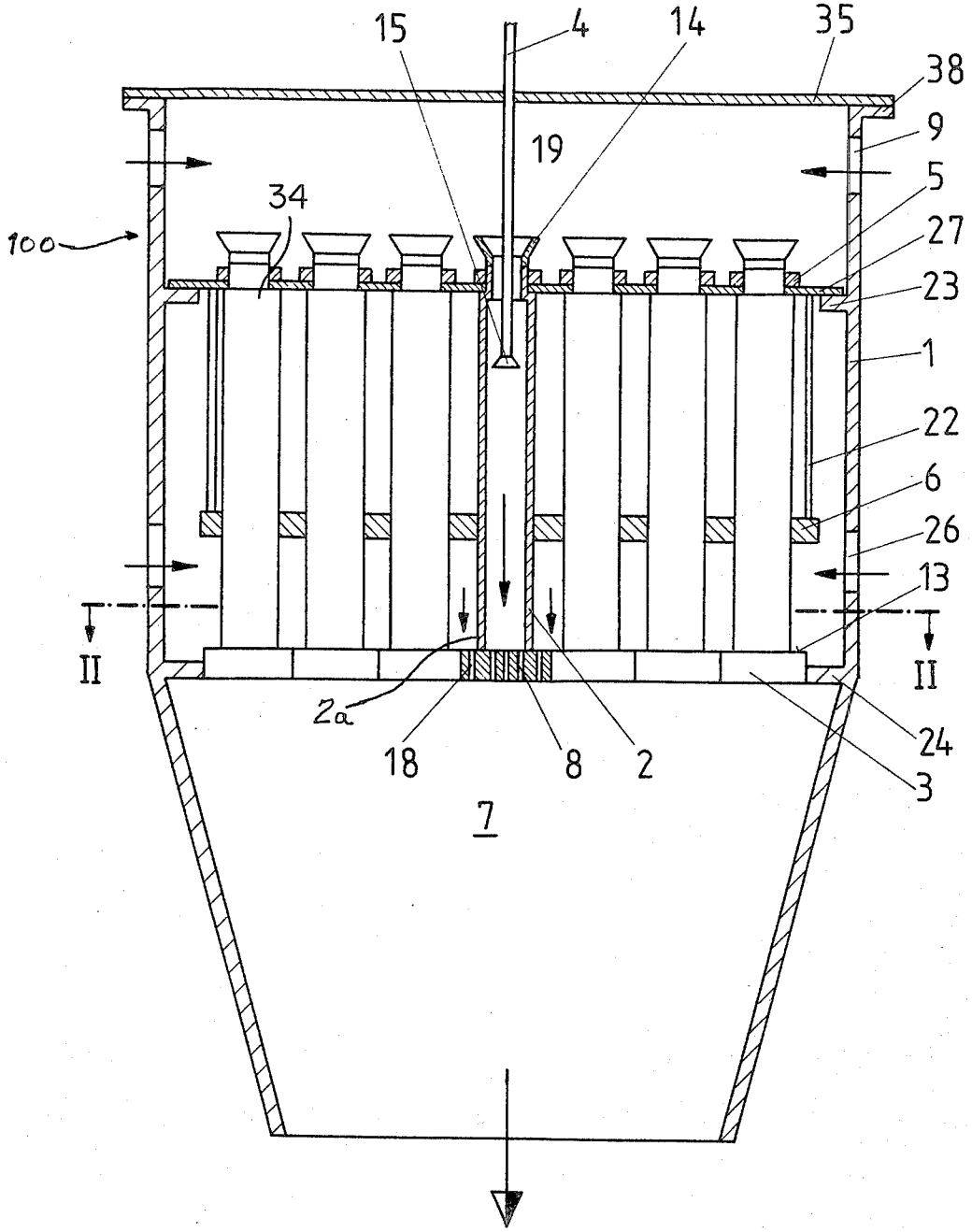
FIG. 1 is a sectional illustration of a combustion chamber or compartment designed according to the invention.
Figure 2:
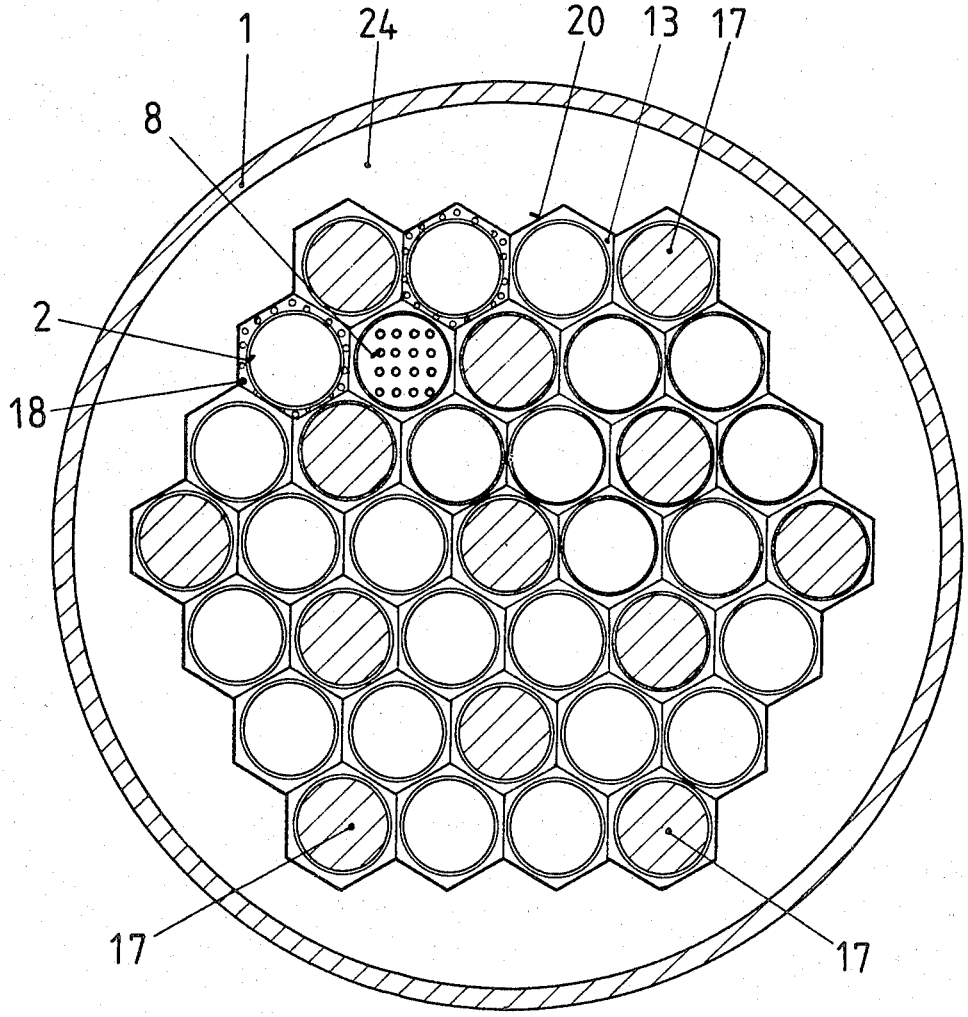
FIG. 2 is a sectional view along the line II—II of FIG. 1 showing an arrangement of the tubular-shaped elements within the combustion chamber.

Turning attention now to the drawings, it is to be understood that there has been illustrated schematically therein an exemplary embodiment of inventive combustion chamber with various modifications of certain of the parts thereof. To simplify the illustration of the drawings it is to be understood that components which are not absolutely necessary for understanding fully the underlying principles and concepts of the present development have been conveniently omitted. Throughout the various figures there have been generally used the same reference characters to denote the same or analogous components. Directing attention now specifically to FIG. 1, there is schematically illustrated therein the concepts of a combustion chamber or compartment, generally indicated in its entirety by reference character 100, designed according to the teachings of the invention. At the upper region of the combustion chamber casing or housing 1 there are arranged a large number of tubular-shaped elements 2 which optimumly fill out the internal space which is available. An example of such arrangement will be better realized by inspecting FIG. 2, where there have been shown, by way of example, thirty-seven such tubular-shaped elements 2. It is to be however expressly understood that such number of tubular-shaped elements 2 is not absolutely crucial for carrying out the invention, rather has been given by way of example and not limitation, since such number depends upon the size of the combustion chamber or compartment 100 which, in turn, depends upon the desired combustion efficiency. A support bridge or support element 27, at which there are connected the tubular-shaped elements 2 by means of closure nut members 5 or equivalent structure, is anchored to a support rib 23. To connect the tubular-shaped elements 2 with the support bridge 27 there also could be naturally employed other or equivalent connection elements. The tubular-shaped elements 2 are laterally guided at their lower region by means of a guide plate 6. A number of support elements 22, which in turn are fixedly connected with the support bridge or element 27, carry the guide plate 6. Of course, the tubular-shaped elements 2 also could be individually guided, as such arrangement has been shown in FIG. 16, in which case then there no longer is employed one guide plate, rather individual guide rings or ring-shaped elements 25 assume such guiding function. In such case, the guide rings 25 are there also supported by support elements 22 which are fixedly connected with the support bridge 27 or equivalent structure. Of course, the tubular-shaped elements 2 also could be differently anchored than with the illustrated support bridge 27, but however care must be taken in such instance to ensure that the anchoring arrangement which is chosen is placed far enough away from the combustion space or chamber 7, so that the thermal expansions do not cause any disturbing effect.

The major portion of the compressed air, which has been prepared in any suitable and therefore not particularly further illustrated compressor, flows through the inlet openings 9 into a distributor chamber 19 provided within the combustion compartment casing 1. The distributor chamber 19 is bounded at its lower end by the support bridge means 27 and at its upper end by a cover 35 which is flanged to a flange rib member 38. The compressed air then flows out of such distributor or distribution chamber 19, through an air funnel 14 or the like, into the related individual tubular-shaped elements 2. The infeed of the fuel is accomplished to each tubular-shaped element 2 by a fuel line 4 and a fuel nozzle 15 protruding into the related tubular-shaped element 2 and having one or a number of not further illustrated fuel openings which ensure for the atomization of the fuel opposite to the air inflow direction. However, the fuel need not necessarily be injected opposite to the air flow. In the event that there is used, for instance, a combustible gas (for example natural gas) then, for instance, the gas can be blown-in in the direction of flow of the air. It is also possible to simultaneously infeed oil and gas and to combust the same. Also when there is used fuel oil there can be infed an extremely small quantity of compressed air through the nozzle 15 to obtain a finer dispersion or atomization of such fuel oil, this compressed air having an excess pressure in relation to the process pressure at which the system is operating. The fuel then admixes with the inflowing compressed air in a manner such that there occurs within the tubular-shaped element 2 a pre-mixing and pre-evaporation process. This process can be intensified by employing a stepped or rimmed mouth 34 at the air inlet of the tubular-shaped element 2, as also best seen by referring to FIG. 16, by means of which there is intensified the resultant turbulence. In such case the injection of the fuel or the blowing-in of the fuel, respectively, through the fuel nozzle 15 is undertaken at an optimum spacing from the stepped mouth 34, but still at the region of the formed turbulence.

During such time as the mixture flows through the related tubular-shaped element 2 up to the outlet 2*a* thereof and through the openings 8 provided at the flame baffle 3, the fuel evaporates and admixes with the air. The degree of evaporation is that much more intense the greater the temperature and the residence time and the smaller the droplet size of the atomized fuel. With an increase in pressure and temperature the critical time duration until self-ignition of the mixture however is decreased, so that the length of the tubular-shaped elements 2 must be dimensioned such that there results as good as possible evaporation during as short as possible time. When working with gas an evaporation of such gas obviously is dispensed with; the gas must only be uniformly distributed in the air.

A residual quantity of compressed air does not flow into the distributor or distribution chamber 19, rather flows in through the inlet openings 26 into the combustion compartment casing 1, distributes itself between the tubular-shaped elements 2 and flows through the openings 18 formed at the flame baffle edge or marginal portion 13 (FIG. 2) into the combustion space or chamber 7, so that the outer part of the flame baffle 3 is cooled to such a degree that there is counteracted any burn-off danger, particularly latently present when producing diverging flame tongues or licks.

The combustion of the mixture, as already mentioned, is attempted to be carried out with the largest possible quantity of excess air, and this is realized, on the one hand, by virture of the fact that the flame still burns and, on the other hand, inasmuch as there is not present too much CO. Good optimization can be, for instance, attained if the quantity of air of the mixture is maintained at approximately 1.8-fold the stochiometric value. The lower closure rib 24 prevents a free convection of the hot air out of the combustion space or chamber 7, and the closure rib 24 is cooled by the same residual air flowing-in through the ports or openings 26, which then outflows through the openings 18 of the neighboring flame baffle edges or marginal portions 13 to the combustion space 7.

The flame baffle 3, forming the closure of the flow downstream located part of the related tubular-shaped element 2, has assigned to it the task of preventing backfiring of the flames from the combustion space 7 into the interior of the tubular-shaped element 2. The inner wall of the combustion compartment casing or housing 1 is provided with a suitable cooling system, which has here not been particularly shown, at the region of the combustion space 7, in other words starting at the flame baffles 3.

Figure 3:
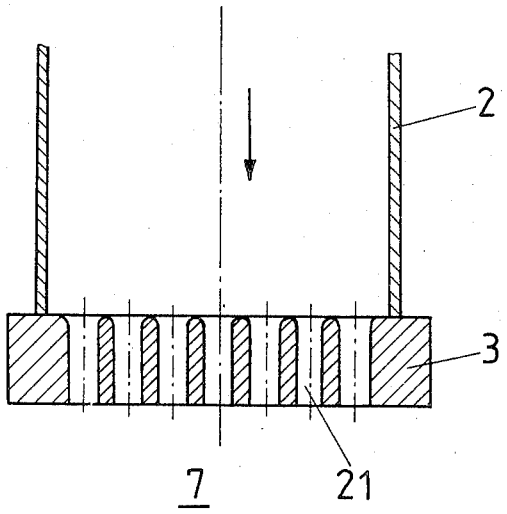
FIG. 3 is a sectional view of a flame baffle having parallel holes or openings.
Figure 4:
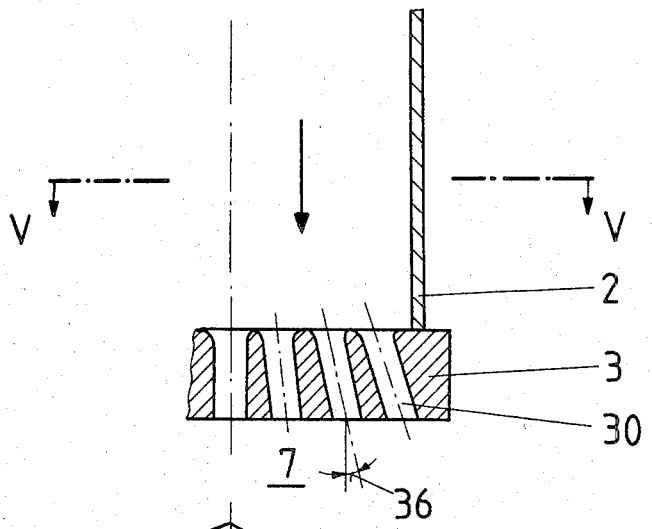
FIG. 4 is a fragmentary sectional view of a further embodiment of flame baffle having inclined holes or openings.
Figure 5:
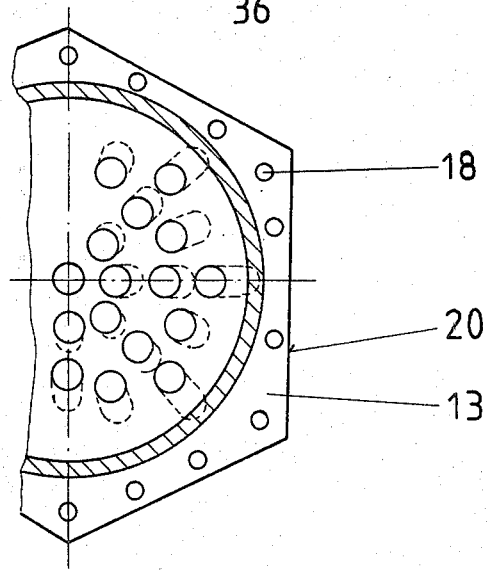
FIG. 5 is a sectional view taken along the line V—V of FIG. 4.
Figure 6:
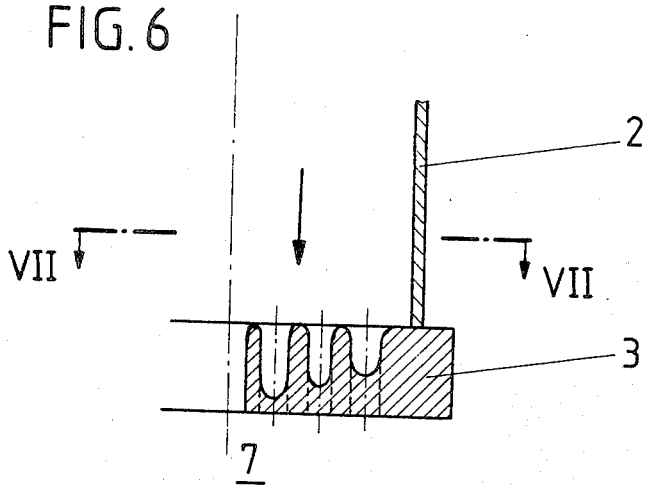
FIG. 6 is a fragmentary sectional view of a still further embodiment of flame baffle having inclined holes or openings.
Figure 7:
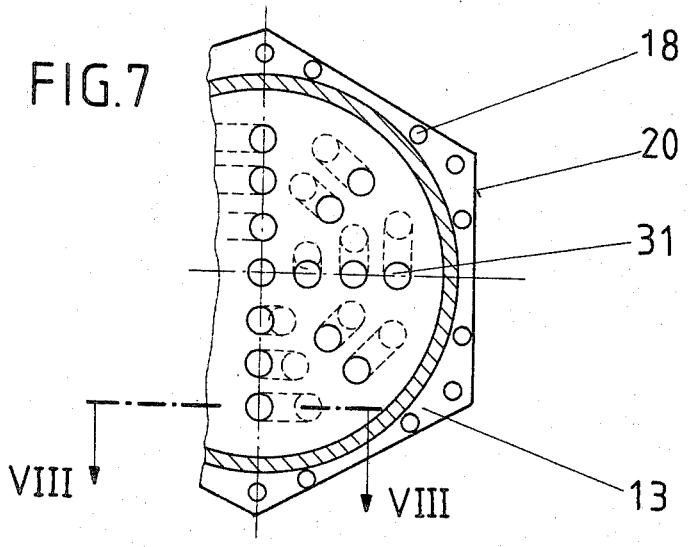
FIG. 7 is a sectional view of the arrangement of FIG. 6, taken substantially along the line VII—VII thereof.
Figure 8:
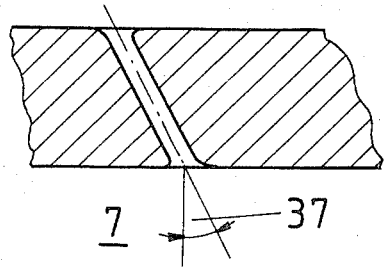
FIG. 8 is a sectional view of FIG. 7, taken substantially along the line VIII—VIII thereof.

As best seen by referring to FIG. 3, the illustrated flame baffle 3 has a number of cylindrical holes or openings 21 which extend essentially parallel to the axis of the related tubular-shaped element 2. If additionally there are to be produced diverging flame licks, then as best seen by referring to FIGS. 4 and 5, the holes or openings 30 in the flame baffle 3, with the exception of the central hole, can be arranged, at an inclination in radial planes of the flame holder 3. The inclination angle 36 continuously increases or remains constant from the center to the periphery of the flame baffle 3. As will be seen by referring to FIGS. 6, 7 and 8, the holes or openings 31 and the flame baffle 3, with the exception of the central hole, also can be arranged at an inclination in tangential planes of the related flame baffle 3. In this case the inclination angle 37, similar to the previously described arrangement, extends so as to continuously increase or remain the same from the center towards the periphery of the flame baffle 3. The length of both the parallel holes or openings 21 and also the inclined holes 30 and 31 must be chosen so as to amount to at least 1.5-fold such hole or opening diameter. By virtue of the thus resulting increased velocity within the respective holes or openings 21, 30 and 31 and the length of these holes there is counteracted any backfiring of the flames of the combustion space or chamber 7. The number of holes 21, 30 and 31 must be chosen in each case so as to accommodate the given conditions which are encountered. In the exemplary embodiment of FIG. 7 there are provided, by way of example and not limitation, twenty-one such openings or holes 31.

Figure 11:
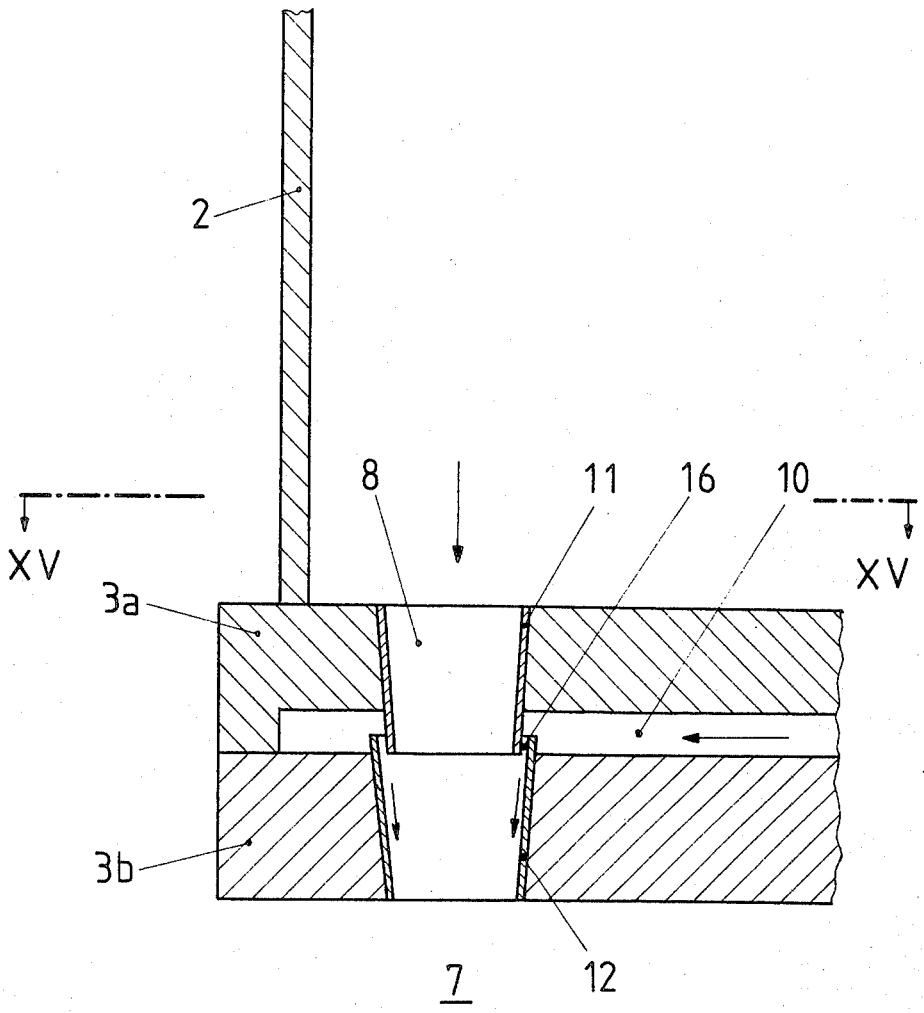
FIG. 11 is a sectional view of a further embodiment of flame baffle constructed with openings serving as injectors.

In the arrangement of FIG. 11 the flame baffle 3 consists of an upper plate 3*a* and a lower plate 3*b*. Between these upper and lower plates 3*a* and 3*b* there extends a channel 10 which flow communicates with the openings or holes 8. The openings 8 formed in the flame baffle 3 are lined with two respective slightly conical bushings 11, 12 and at the region of the channel 10 such overlap or interfit telescopically and with play, as generally indicated by reference character 16. A backfiring of the flames out of the combustion space or chamber 7, especially at the boundary layer along the wall of the bushing 12, is counteracted in that compressed air is introduced through the flow channel or duct 10. This compressed air can flow through the provided play or gap 16, along the endangered wall of the bushing 12, and can then again outflow together with the mixture. Flow detachment, which could promote the danger of flame backfiring, is prevented by the conical configuration of the openings 8.

Figure 15:
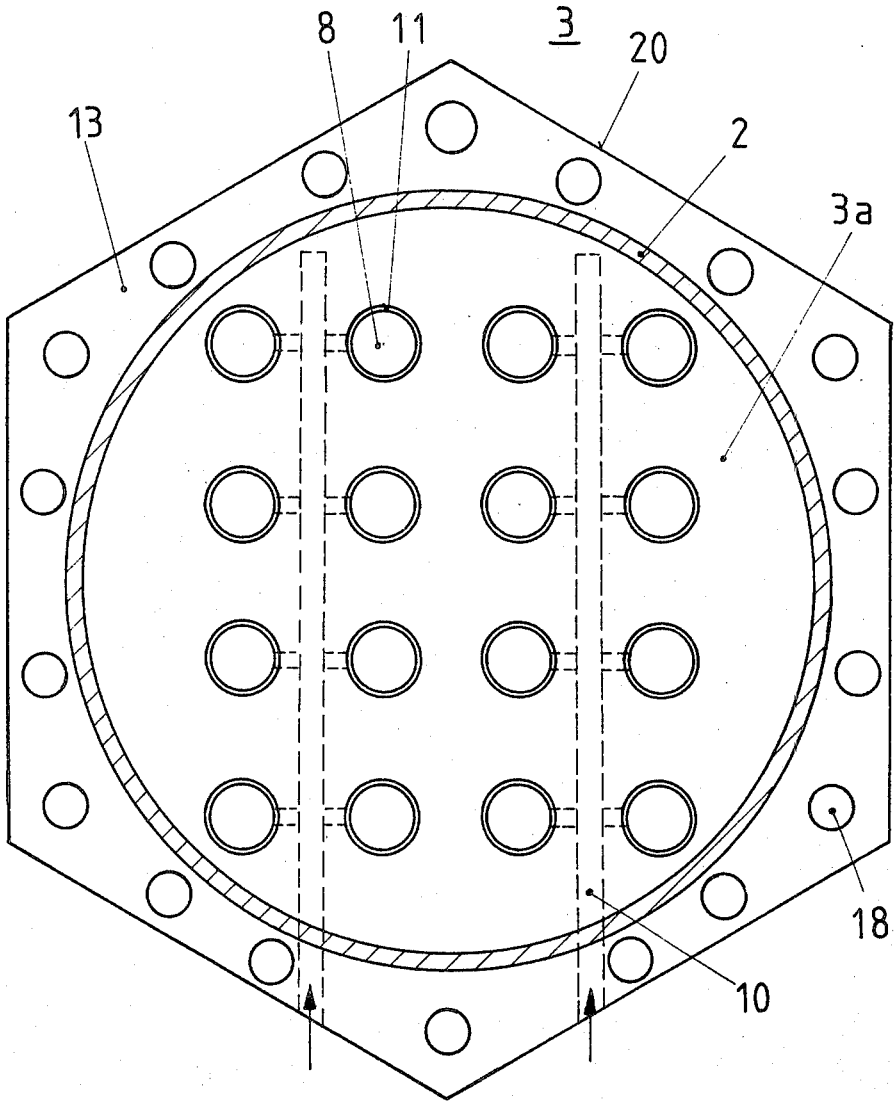
FIG. 15 is a view of the flame baffle of FIG. 11 including the illustration of the configuration of the air infeed channel.

From the arrangement of FIG. 15 it will be apparent that the flame baffle 3, illustrated in FIG. 11, possesses by way of example sixteen openings 8 which are symmetrically supplied with compressed air by means of two channels 10. Of course, the supply of compressed air to the openings or holes 8 provided at the flame baffle 3 can be fulfilled by other channel configurations or equivalent structure.

Figure 14:
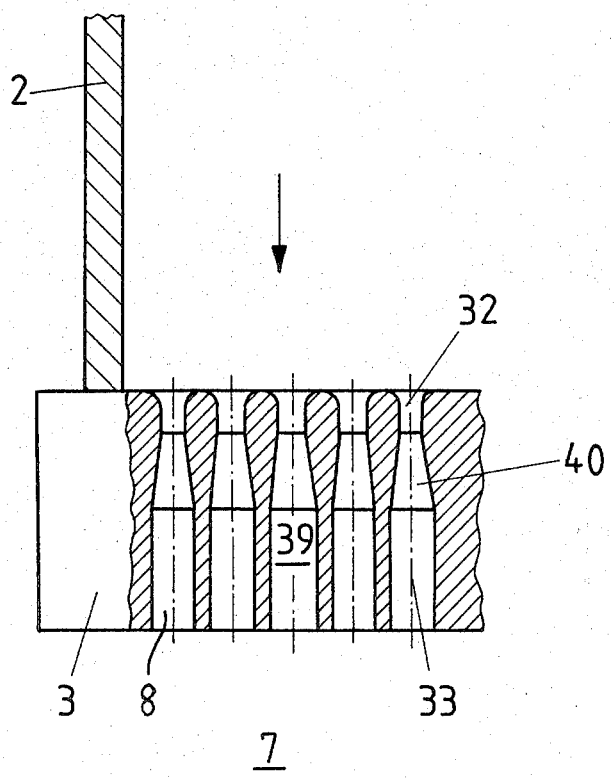
FIG. 14 is a sectional view of a further embodiment of flame baffle having openings constructed as diffusors.

As will be seen from the illustration of FIG. 14, the openings or holes 8 are formed in the flame baffle 3 in the form of diffusors 39. In the flow direction of the mixture, leading to the combustion space or chamber 7, there is arranged an initially cylindrical bore 32, part of which is constructed as a diffusor 40, following which there is provided a cylindrical bore 33 of larger diameter than the inlet bore 32, and the latter has a length of at least 1.5-times the bore diameter. With this design, with the same pressure loss, there is possible a higher velocity at the narrowest location or throat, something which is beneficial in terms of increased security against flame backfiring out of the combustion chamber or space 7. By virtue of the cylindrical bore 33 the starting flame portion within the combustion space or chamber 7 is located at a suitable distance from the diffusor 40. Consequently, in the presence of a momentary detachment or separation of the flow from the wall of the diffusor 40 this flow again will be brought into contact with the wall at the subsequent cylindrical portion 33.

Figure 9:
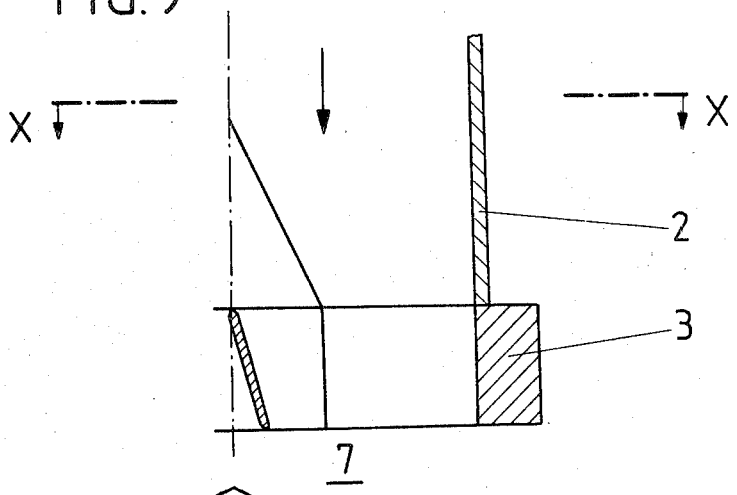
FIG. 9 is a sectional view of a still further embodiment of flame baffle provided with a spin or twist body taken substantially along the line IX—IX of FIG. 10.
Figure 10:
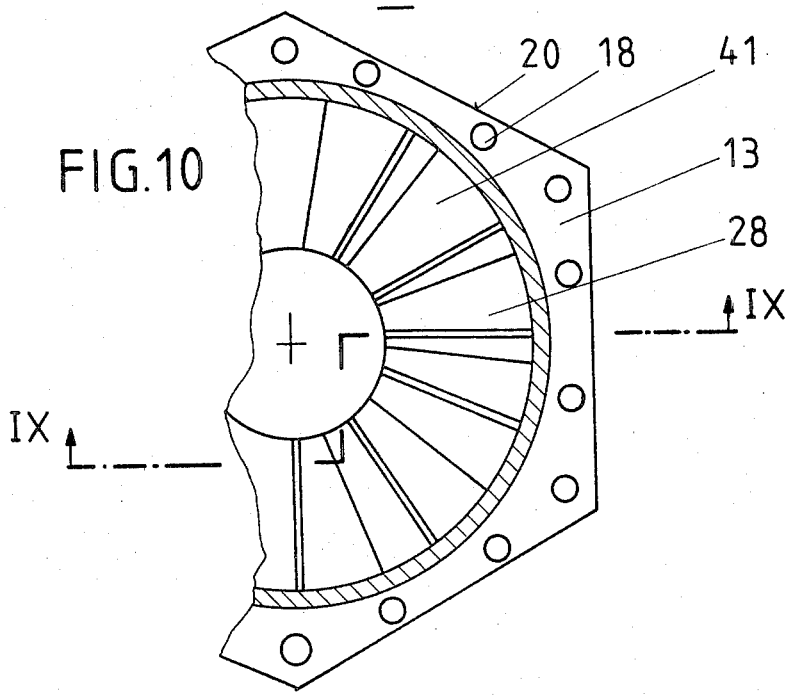
FIG. 10 is a sectional view of the arrangement of FIG. 9, taken substantially along the line X—X thereof.

As best seen by referring to FIGS. 9 and 10, the flame baffle 3 can be provided with a spin or twist-imparting body 28. Such spin or twist-imparting body 28 is provided with openings 41, for instance with fourteen such openings, and serves to impart to the mixture a spiral or spin-shaped flow towards the combustion space or chamber 7. Such spin or twist-imparting body 28 promotes good air-jet admixing of the fuel and air mixture and a good heat distribution, so that there is realized a homogeneous temperature and velocity distribution following the combustion space 7, with the result that the not particularly illustrated turbine is uniformly impinged with such flowing medium.

Of course, the tubular-shaped elements 2 and the individual flame baffles 3 themselves can be constructed in different combinations according to the various features of FIGS. 3, 4 and 5, 6, 7 and 8, 9 and 10, 11 and 15 or 14.

As already previously indicated, the combustion chamber casing 1 is optimumly filled with a larger number of tubular-shaped elements 2. As best seen by referring to FIG. 2, below the, for instance, thirty-seven tubular-shaped elements 2 there are geometrically uniformly distributed thirteen pilot elements 17. During start-up of the combustion compartment or chamber there is initially placed into operation the pilot elements 17 by a not particularly shown initial ignition device. With load increase the flames jump from the pilot elements 17 to the surrounding elements which have just been placed into operation.

The openings 8 in the flame baffles 3 of the pilot elements 17 can be selectively constructed like the holes or openings 30 and/or like the holes or openings 31. There also can be provided for the pilot elements 17 the spin-imparting or twist-imparting bodies 28, which likewise produce, just like the holes 30 and 31, diverging flame licks, and thus, enhance the firing or ignition of the surrounding tubular-shaped elements 2.

Figure 12:
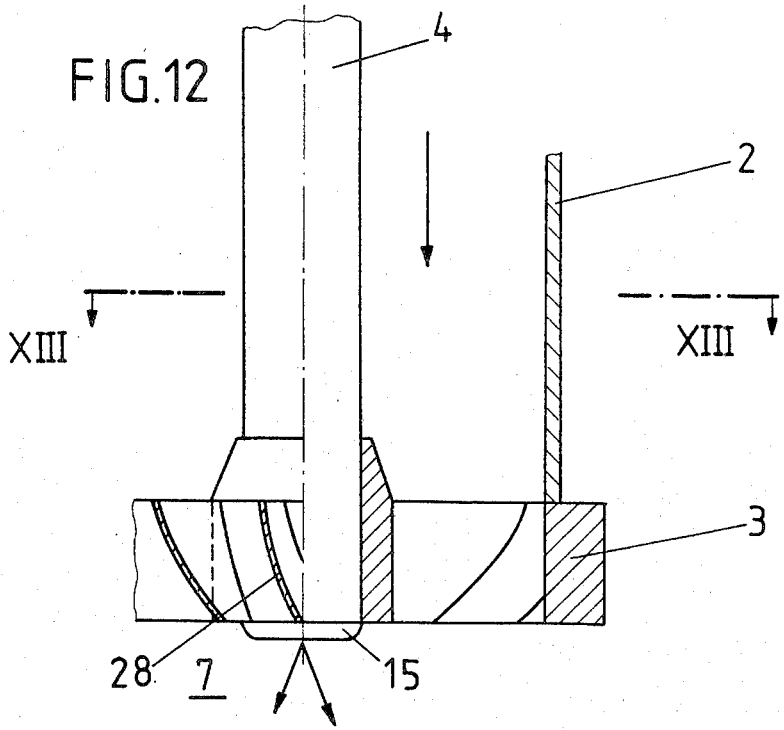
FIG. 12 is a sectional view illustrating a pilot element having a diffusion flame.
Figure 13:
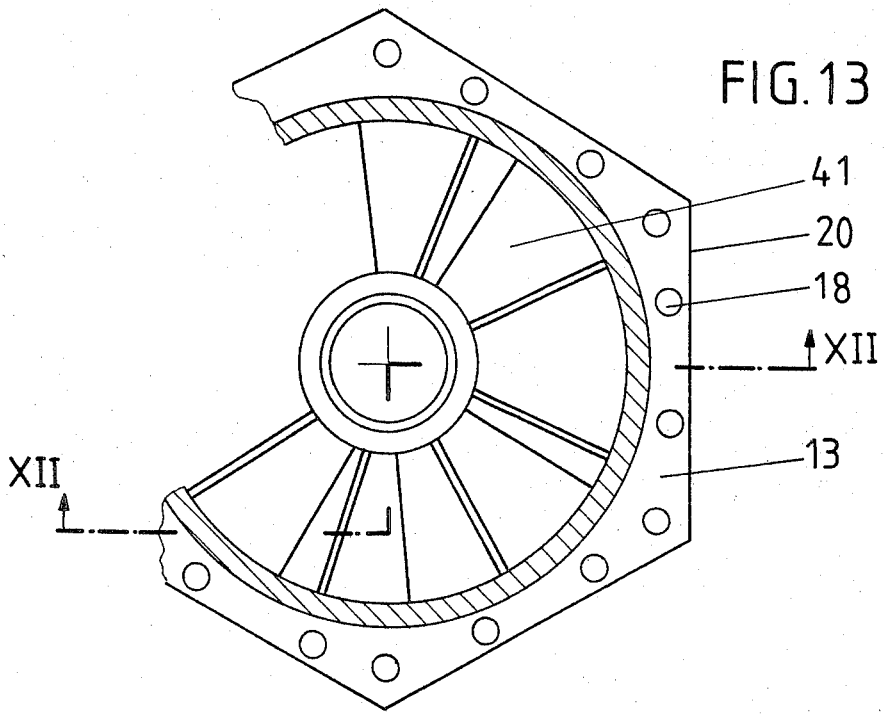
FIG. 13 is a sectional view of the arrangement of FIG. 12, taken substantially along the line XIII—XIII thereof.

The arrangement as shown in FIGS. 12 and 13, in other words equipped with the spin-imparting body 28, is considered to constitute a further variant of the pilot element 17. Since in this case the fuel nozzle 15 protrudes into the combustion space or chamber 7, no premixing and pre-evaporation process occurs in the tubular-shaped element 2. This variant is accordingly only suitable as a starting aid, so that with this embodiment there need only be provided very few pilot elements 17.

As will be seen by referring to FIGS. 2, 5, 7, 10, 13 and 15, the flame baffle 3 is formed in its circumferential or peripheral direction so as to have a hexagonal configuration 20. From these figures it will be apparent that the openings or holes 18 formed at the flame baffle base 13 are uniformly distributed between the hexagonal-shaped circumference 20 and the tubular-shaped element 2. A polygon play 29 compensates for thermal expansions at this region, as has been shown in FIG. 16 for instance.

Figure 16:
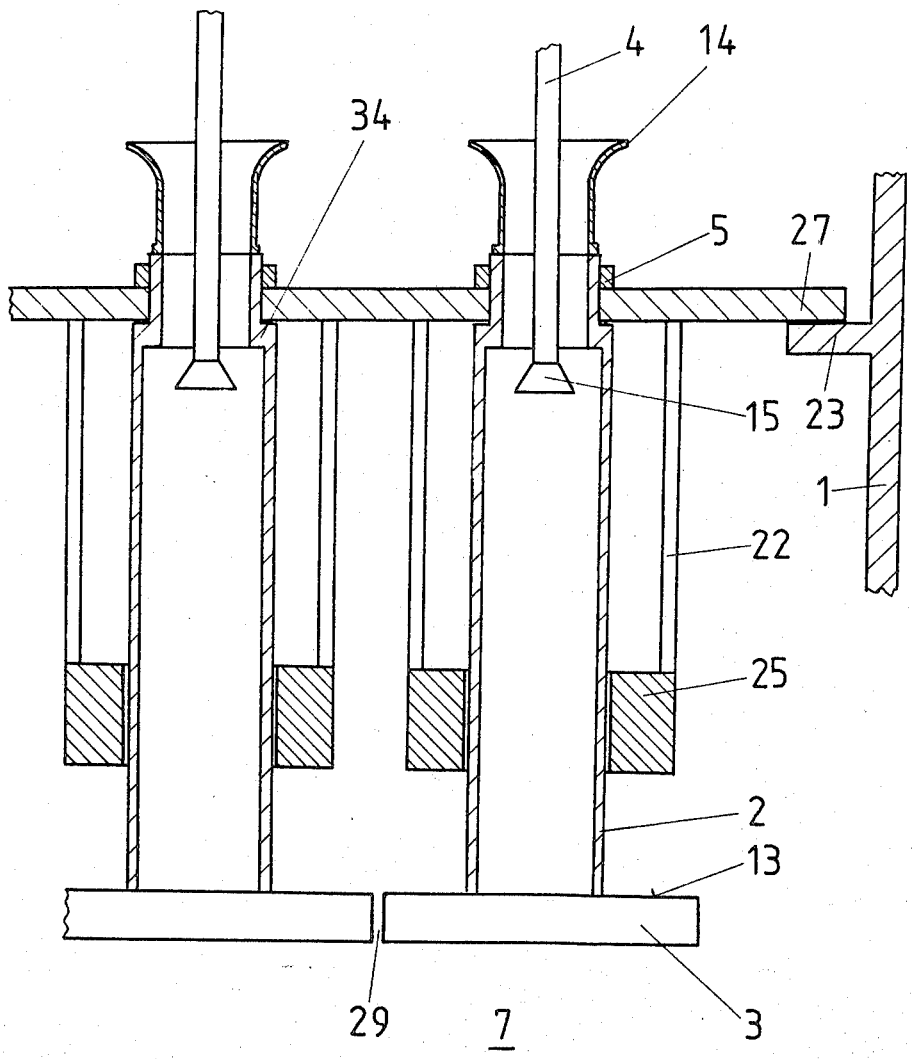
FIG. 16 is an illustration of the tubular-shaped elements having boardered mouths and guided by means of a ring element or ring-shaped member.

As already indicated, it will be recognized from the illustration of FIG. 16 that at the air inlet of the tubular-shaped element 2, following the air funnel or trumpet 14, there is mounted a rimmed or stepped mouth or mouthpiece 34 which, at this region, in other words, directly about the fuel nozzle 15, generates turbulence. This turbulence is suitable for intensifying the pre-mixing, atomization and pre-evaporation process, in addition to the above-described measures, in other words, especially by virtue of the fine fuel injection opposite to the air inflow direction. Of course, it is also possible to use other turbulence intensifying means instead of the stepped mouth 34.

While there are shown and described present preferred embodiments of the invention, it is to be distinctly understood that the invention is not limited thereto, but may be otherwise variously embodied and practiced within the scope of the following claims. Accordingly,

What we claim is:

1. A combustion compartment for a gas turbine comprising:

(a) a combustion compartment casing containing therein an air distributor chamber and a combustion chamber spatially separated from one another;
(b) a number of substantially tubular-shaped elements arranged between the air distribution chamber and the combustion chamber;
(c) nozzle means for infeeding a combustible medium to an end of said tubular-shaped elements located at the side of the air distributor chamber;
(d) the admixing and pre-evaporation of said combustible medium occurring within said plurality of tubular-shaped elements;
(e) each said tubular-shaped element having an end located at the side of the combustion chamber;
(f) at least one flame baffle for closing the end of the tubular-shaped elements located at the side of the combustion chamber, said flame baffle being provided with openings;
(g) at least one pilot element located between said tubular-shaped elements; and
(h) said combustible medium comprises fuel oil which is infed by said nozzle means and which is premixed and pre-evaporated within said tubular-shaped elements and admixed with compressed air with a large excess-air coefficient.

2. A combustion compartment for a gas turbine comprising:
(a) a combustion compartment casing containing therein an air distributor chamber and a combustion chamber spatially separated from one another;
(b) a number of substantially tubular-shaped elements arranged between the air distribution chamber and the combustion chamber;
(c) nozzle means for infeeding a combustible medium to an end of said tubular-shaped elements located at the side of the air distributor chamber;
(d) the admixing of said combustible medium occurring within said plurality of tubular-shaped elements;
(e) each said tubular-shaped element having an end located at the side of the combustion chamber;
(f) at least one flame baffle for closing the end of the tubular-shaped elements located at the side of the combustion chamber, said flame baffle being provided with openings;
(g) at least one pilot element located between said tubular-shaped elements; and
(h) said combustible medium comprises a fuel gas which is infed by said nozzle means and which is admixed with compressed air within said tubular-shaped elements with a large excess-air coefficient.

3. The combustion compartment as defined in claim 1 or 2 further including:
a plurality of said pilot elements;
said plurality of pilot elements being geometrically uniformly arranged below said tubular-shaped elements such that during placing into operation of the individual tubular-shaped elements, in a staggered fashion as a function of the turbine load, there occurs a jumping-over of flames to surrounding tubular-shaped elements.

4. The combustion chamber as defined in claim 1, wherein:
said fuel oil is injected by said nozzle means in a direction opposite to a direction of flow of the compressed air.

5. The combustion compartment as defined in claim 1 or 2 wherein:
said openings in the flame baffle are in the form of substantially cylindrical holes extending essentially parallel to the lengthwise axis of the related tubular-shaped element; and
said holes having a length of at least equal to or greater than 1.5-fold the hole diameter.

6. The combustion compartment as defined in claim 1 or 2 wherein:
said openings in the flame baffle comprise holes extending at an inclination in radial planes of the flame baffle;
the angle of inclination of said holes continuously increasing from the center towards the periphery of the flame baffle; and
the length of such holes being at least equal to or greater than 1.5-fold the hole diameter.

7. The combustion compartment as defined in claim 1 or 2 wherein:
said openings in the flame baffle comprise holes extending at an inclination in radial planes of the flame baffle;
the angle of inclination of said holes remaining essentially constant from the center towards the periphery of the flame baffle; and
the length of such holes being at least equal to or greater than 1.5-fold the hole diameter.

8. The combustion compartment as defined in claim 1 or 2 wherein:
the openings in the flame baffle comprise holes extending at an inclination in tangential planes of the flame baffle;
the angle of inclination of said holes continuously increasing from the center towards the periphery of the flame baffle; and
the length of the holes being at least equal to or greater than 1.5-fold the whole diameter.

9. The combustion compartment as defined in claim 1 or 2 wherein:
said openings in the flame baffle comprise holes extending at an inclination in tangential planes of the flame baffle;
the angle of inclination of said holes remaining essentially constant from the center towards the periphery of the flame baffle; and
the length of the holes being at least equal to or greater than 1.5-fold the whole diameter.

10. The combustion compartment as defined in claim 1 or 2 further including:
spin-imparting bodies provided for the openings at the flame baffle.

11. The combustion compartment as defined in claim 1 or 2 wherein:
said flame baffle comprises an upper plate and a lower plate;
channel means extending between said upper plate and said lower plate and flow communicating with said openings of said flame baffle;
two respective conical bushing means lining each of said openings;
said bushing means telescopically overlapping one another with play at the region of said channel means; and
a medium flowing through said channel means flowing-out along with the combustible medium emanating from the related tubular-shaped element.

12. The combustion compartment as defined in claim 1 or 2 wherein:

the openings in the flame baffle are constructed as diffusors following which there are arranged substantially cylindrical openings; and said substantially cylindrical openings having a length amounting to at least 1.5-fold their diameter.

13. The combustion compartment as defined in claim 1 or 2 wherein:

said flame baffle has an edge extending about an outer jacket of the related tubular-shaped element; and said flame baffle edge being provided with a number of openings.

14. The combustion compartment as defined in claim 1 or 2 wherein:

the outer circumference of the flame baffle is of substantially polygonal configuration.

15. The combustion compartment as defined in claim 1 or 2 further including:

an air funnel and a subsequently merging stepped mouth provided for each tubular-shaped element at an end thereof located at the side of the air distributor chamber.

* * * * *